United States Patent [19]

Nyström

[11] Patent Number: 4,786,334

[45] Date of Patent: Nov. 22, 1988

[54] METHOD OF CLEANING THE BOTTOM OF A POOL

[76] Inventor: Mikael Nyström, Källängsvägen 8,, S-151 57 Södertälje, Sweden

[21] Appl. No.: 82,047

[22] Filed: Aug. 5, 1987

[30] Foreign Application Priority Data

Aug. 20, 1986 [SE] Sweden ..... 8603505

[51] Int. Cl.[4] ..... B08B 5/04

[52] U.S. Cl. ..... 134/21; 134/18; 134/22.12; 134/24; 15/1.7; 210/169

[58] Field of Search ..... 15/1.7; 210/169; 134/18, 21, 22.12, 24

[56] References Cited

U.S. PATENT DOCUMENTS 3,439,368 4/1969 Myers ..... 15/1.7
3,950,809 4/1976 Schatzman ..... 15/1.7
4,518,437 5/1985 Sommer ..... 15/1.7
4,651,376 3/1987 Ford ..... 15/1.7

FOREIGN PATENT DOCUMENTS 0099489 2/1984 European Pat. Off. .

*Primary Examiner*—Patrick P. Garvin
*Assistant Examiner*—George R. Fourson
*Attorney, Agent, or Firm*—Ostrolenk, Faber, Gerb & Soffen

[57] ABSTRACT

The invention relates to a method of cleaning the bottom of a pool with the aid of a pool cleaner. The pool cleaner travels along the bottom of the pool and collects material lying at the bottom of the pool. The pool cleaner is arranged to travel to and fro in straight, parallel paths between two opposite walls of the pool. At the walls the pool cleaner is turned by rotating a half turn so that, after turning, it will have been displaced laterally perpendicular to the initial direction of travel.

8 Claims, 3 Drawing Sheets

METHOD OF CLEANING THE BOTTOM OF A POOL

Figure 1:
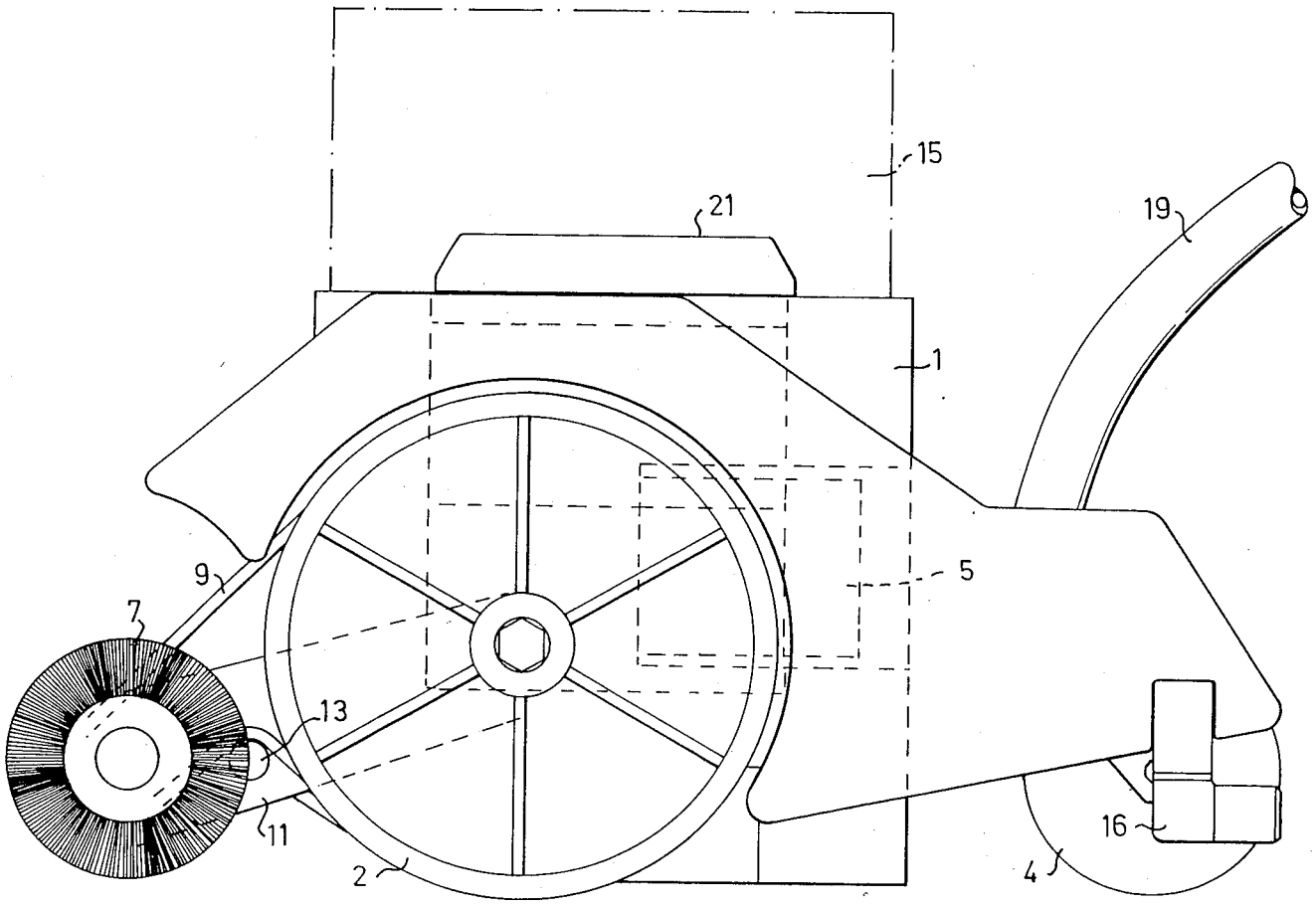

The invention relates to a method of cleaning the bottom of a pool with the aid of a self-propelling, motorised pool cleaner, the pool cleaner travelling to and fro, with parallel movement at change of direction, in straight paths between two opposite walls of the pool while collecting material lying at the bottom of the pool, said pool cleaner comprising control means arranged to emit control signals to the members governing movement of the pool cleaner, in order to change the direction of travel when encountering a wall of the pool.

Many different types of automatic pool cleaners exist, operating in various ways to clean the bottom of a pool. These pool cleaners comprise collecting members, usually in the form of rotating brushes arranged at two ends of the pool cleaner. These brushes collect loose material lying at the bottom of the pool, which is sucked up with the aid of a pump, into filter bags on the machine to be disposed of subsequently. The pool cleaner is propelled along the bottom of the pool by a drive motor.

Two main principles pertain in moving a pool cleaner along the bottom of a pool. In the first the pool cleaner is allowed to move along the bottom while being subjected to random changes of direction. It might, for instance, be time-controlled, or the changes of direction may occur when the cleaner encounters the edge of the pool, sensing devices causing the drive means to reverse direction and the pool cleaner to travel in arbitrary direction away from the wall. The random movement principle has considerable drawbacks, due both to its inefficiency since several outer regions will be covered several times, and to the cleaning being unsatisfactory since many areas will not be traversed at all and will therefore never be cleaned.

The second principle is based on controlled movement of the pool cleaner so that it will move in overlapping, parallel paths and being accurately turned at the pool walls. Hitherto it has been necessary to use pool cleaners with reversible drives, operating in two directions, i.e. forwards and backwards. Suction capacity for both directions of travel had therefore to be provided, as well as brushes and sensing devices at both ends of the pool cleaner. Such machines are therefore relatively expensive.

An example of the random movement principle is shown in EP-A-85200932.3, for instance, where the pool cleaner described is designed to operate in two directions which, as mentioned earlier, increases the cost of the machine. The changes of direction in this arrangement are time-controlled.

In another known pool cleaner, also designed to operate in two directions, the machine runs obliquely (not perpendicularly) towards the wall of the pool and, after reversal of the drive, runs obliquely out again. Besides being rather expensive, both these pool cleaners have the general drawbacks described for the randomly controlled system.

A pool cleaner with controlled travel across the entire pool is known through EP-A 83106211.1, for instance. In this case the drive is reversed at the pool wall so that the cleaner moves in parallel, overlapping paths across the bottom of the pool. The machine is displaced laterally by being caused to move first at an angle to the initial direction and then being turned so that it is parallel to the previous path. A considerable drawback with this procedure is that two control impulses are required. This results either in great inaccuracy as to parallellity of the paths, or requires a complicated control system which in the case described consists of a compass-controlled direction indicator. The alignment is further complicated since the machine cannot be constructed exactly symmetrically and will not therefore behave exactly the same when travelling forwards as it does when travelling backwards.

In another known method of this type, the pool cleaner is run to and fro between opposite pool walls, travelling perpendicularly in towards a wall but leaving it at an angle to the previous path after reversal of the drive direction, so that it encounters the next wall at an angle and leaves it again at an angle. The changes in direction of travel are effected with the aid of two fenders, adjustable in longitudinal direction, arranged at each end of the apparatus, i.e. four fenders in all, which encounter the pool wall and align the cleaner in relation thereto. At one end of the cleaner, the fenders protrude the same distance and the pool cleaner will therefore back out perpendicularly from the wall, whereas the fenders protrude different lengths at the other end and the cleaner will therefore be aligned at an angle to the wall and will travel in a straight path forming an angle with the previous path. The fenders of different lengths are adjusted to ensure that no area of the pool bottom is missed. Ideally, therefore, the cleaner will move diagonally over the previous path until upon reaching the opposite wall, it has been displaced one path width. The cleaner thus operates extremely inefficiently since at least half the surface already covered is cleaned again. Furthermore, the fenders must be accurately adjusted according to the width of the pool to prevent the overlap being even greater than 50% or parts not being cleaned. In practice such adjustment is extremely difficult and is extremely time-consuming if an optimum result is to be obtained. Furthermore, it is entirely unsuitable for automatic cleaning of pools of irregular shape since the same unsatisfactory results are obtained as with random movement.

The object of the invention is to achieve a method of automatically cleaning the bottom of a pool, of the type described in the introduction which, although permitting a simpler and less expensive design for the pool cleaner, entails more efficient and reliable cleaning than previous methods have been able to offer.

The object mentioned above is achieved by the pool cleaner, after having travelled in a straight path towards one wall, being turned a half turn and simultaneously displaced laterally perpendicular to the initial direction of travel, the pool cleaner being thereafter driven on a path parallel to the initial direction of travel to the opposite wall of the pool, the pool cleaner being there again turned a half turn and simultaneously displaced laterally in the same direction as the lateral displacement at the previous turn, and the pool cleaner thereafter being driven back to the opposite wall of the pool, the process then being repeated until the desired bottom section has been covered.

Cleaning the pool in this way, i.e. collecting material in only one direction of travel and turning the machine 180° at the pool walls, offers considerable advantages over known methods.

The main advantage is that the pool cleaner can be simpler and less expensive in design while still cleaning the pool more efficiently and at least as reliably as previously known methods. The pool cleaner need be provided with only a single collection means and need be designed to suck in water from only one direction. A pump with less capacity, and thus less expensive, is therefore sufficient. The parallel paths are obtained by only one control impulse at the turning positions and, since the pool cleaner travels in only one operating direction, its course-maintaining stability is increased. Furthermore, the machine can be made more compact so that the majority of its weight is taken by a smaller support member surface, the motor and pump being located immediately above or close to two drive wheels, for instance, thus giving high friction between support members and the bottom of the pool. Only one fender is required if the pool wall is utilized for aligning the pool cleaner.

Figure 2:
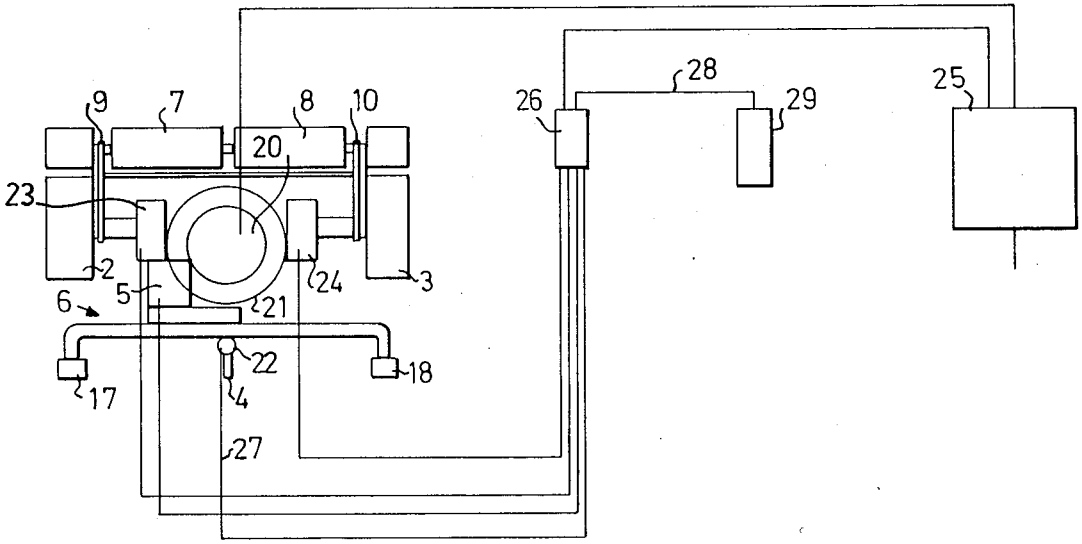
Figure 3:
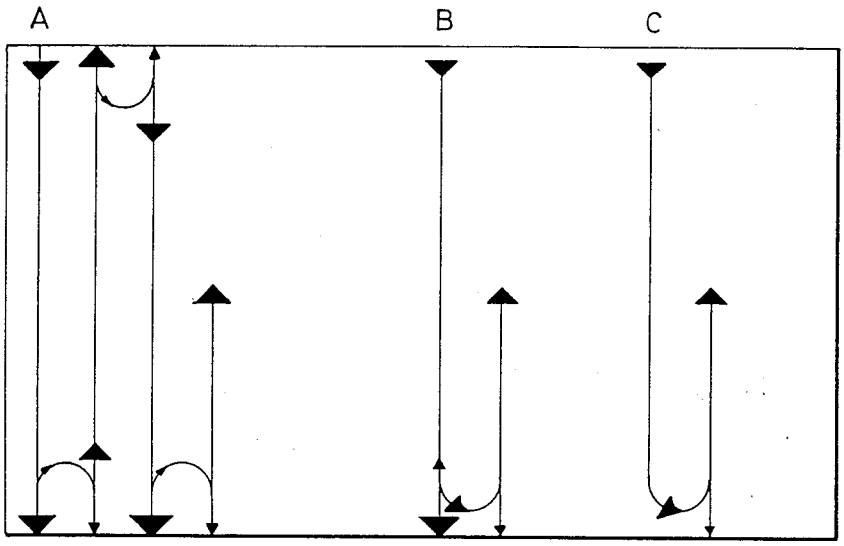
Figure 4:
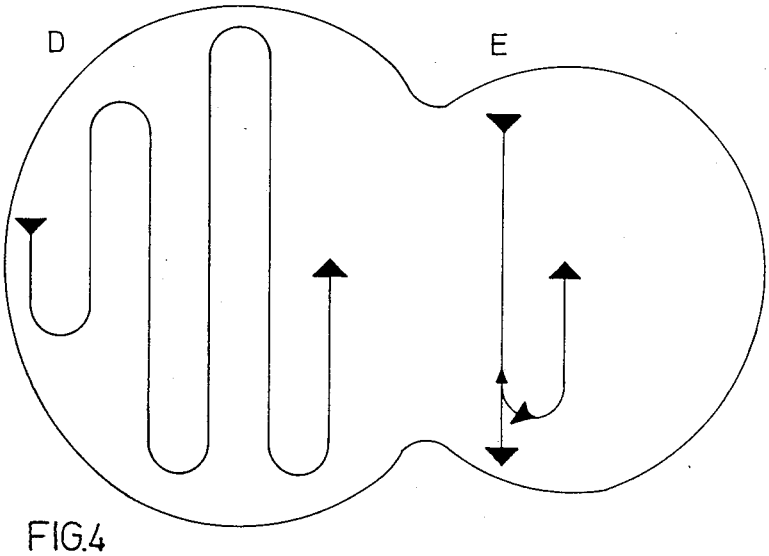

The invention will be described in more detail in the following, with reference to the accompanying schematical drawings in which, FIG. 1 shows in side view, an example of a pool cleaner which may be used for performing the invention, FIG. 2 shows a block diagram of the pool cleaner shown in FIG. 1, FIG. 3 shows three different turning programs possible according to the invention, and FIG. 4 shows additional programs according to the invention, primarily intended for cleaning pools of irregular shape.

The pool cleaner shown in FIGS. 1 and 2 comprises a chassis 1, in which drive wheels 2 and 3 and a rear support wheel 4 are rotatably journalled. For travel across the bottom of the pool, the drive wheels 2, 3 are connected to a reversible motor 5 via a transmission chain comprising gears of convention type, not shown in detail, couplings 23, 24 and drive shaft.

The electric motor 5 also drives two brush rollers 7, 8 arranged on the same shaft, by way of two belt transmissions 9, 10. The brushes 7, 8 are movably supported in relation to the drive shaft by means of pivotably journalled brush holders 11, 11 at the sides of the pool cleaner 1 on the drive shaft. Each brush holder 11, 12 is provided with a slip-roll 13 having a surface of low-friction material over which the belt 9 glides. The slip-roll 13 has two functions: that of regulating the belt tension and increasing the angle at which the belt 9 surrounds the brush-roller axle and also that of preventing plasters or similar matter collected up from entering and catching between the belt 9 and the belt groove.

The pool cleaner also includes a pump with pump housing 21 and pump motor 20, which sucks up water and material collected by the brushes 7,8 and carries it to a store permeable to water, such as a filter bag 15. This may be of any suitable design and is not therefore shown in detail, but merely indicated by broken lines in FIG. 1. A fender 16 is provided at the rear of the pool cleaner, to align it with a pool wall after a turning movement. The fender 16, best illustrated in FIG. 2, comprises two stops 17, 18 at the sides of the cleaner, arranged so that a surface at a tangent to these stops 17, 18 forms a right angle to the direction of travel of the pool cleaner. The driven support wheel 4 is provided with an impulse emitter and an impulse receiver 22 is arranged on the chassis 1. Such impulse generators are known per se and many types are possible. The impulse emission may be purely mechanical, for instance, utilizing one or more spring tongues actuating a switch, for instance, or it may occur with out contacts, inductively or capacitively, for instance, as is deemed expedient. The number of transducers is of course dependent on the requirement.

During normal movement impulses will be generated continuously, indicating that the cleaner is travelling. When the machine stops after having encountered a wall of the pool, the impulses will cease, thus indicating that a wall has been encountered. Anyone skilled in the art will obviously realize that other sensing means are also possible. Mechanical sensing means such as switches which are depressed upon contact with a wall, or sensing means not requiring contact such as reflection photocells, are other examples. Common for all feasible sensors, however, is that they generate a signal to indicate the presence of a wall.

19 denotes a floating cable through which leads run to supply the drive motor 5 and pump motor 20 with power. The leads are connected to an external power source via a transformer 25. Additional leads governing the function of the pool cleaner are also enclosed in the floating cable.

Other components, electric power supply and control are described with reference to FIG. 2, showing the construction of the pool cleaner in block form. Each driving wheel 2, 3 is provided with a separate magnetic coupling 23 and 24, respectively, allowing the relevant drive wheel 2, 3 to be coupled to or released from the drive shaft. To achieve a straight path of travel, both wheels 2 and 3 are connected to the drive shaft so that the pool cleaner moves along a straight path when the drive motor 5 receives current.

The transformer 25 transforms the supply power to 48V alternating voltage. The pump motor 20 communicates directly with the transformer 25 and is thus always driven when there is voltage at the transformer output. Water is drawn into the pump housing 21 and out into the filter 15, where solid material is caught while the water flows through.

The power supply to the magnetic couplings 23, 24 of the drive motor 5 is controlled by a circuit 26 which, via a lead 27, is connected to the impulse sensor 22 and, via a lead 28, to an operating box 29 which is preferably designed to be portable and includes switches for switching between automatic and manual operation. The operating box is provided with buttons for oscillating movements in various directions and for driving forwards or backwards when in manual mode.

As stated earlier, the apparatus is driven forwards by the two wheels 2, 3 being driven by the drive shaft. During movement the impulse sensor 22 emits signals to the control means 26 which comprises a time-delay circuit which is cleared by a signal from the sensor and releases a signal after a time interval exceeding that between two impulses. This time-delayed signal now activates a control program during which the current delay to the drive motor 5 is pole-inverted, the drive thus being reversed and the cleaner moving backwards. Reversing is time-controlled so that the apparatus moves back about 5 dm, after which the current supply to one of the magnetic couplings 23, 24 is disconnected for a predetermined period. Since one of the wheels 2, 3 is driven and the other not, the whole apparatus will swing around. The predetermined time interval is such in relation to the speed of the pool cleaner that it will be turned half a turn. At the end of the predetermined time interval both magnetic couplings 23, 24 will receive current. The apparatus will then move back until it is stopped by the pool wall and, with the aid of the fender 16, is aligned to the wall. After a suitable period for alignment the direction of drive is again reversed so that the pool cleaner travels along the bottom of the pool in the opposite direction. The process triggered by sensor 22 is then repeated at the opposite wall, with the difference that the control means 26 now disconnects the current supply to the other of the magnetic couplings 24, 23, thus releasing the second wheel 3, 2 from the drive shaft while the wheel 2, 3 which was not driven in the previous turn, will now be driven. The procedure is repeated until the desired pool section has been covered, the driving wheels 2, 3 being alternately connected and disconnected to the drive shaft at the turning points.

FIGS. 3 and 4 show various examples of the method according to the invention, curve A in FIG. 3 corresponding to the procedure described above so that no further explanation is required here. The larger arrows in the figures indicate forward direction whereas the smaller arrows indicate that the apparatus is reversing.

In curve E of FIG. 4 the control means 26 is arranged to steer the cleaner towards a pool wall along a straight path, after which it is backed a suitable distance from the wall, 5 dm for instance, whereupon it is turned 180° and again driven forwards towards the opposite pool edge. This procedure is particularly suitable for pools of irregular shape since the cleaner is not aligned to a wall behind.

Curve D in FIG. 2 also describes a procedure particularly suitable for irregularly shaped pools. The pool cleaner is here provided with sensors capable of detecting the wall while still at a distance therefrom. At a suitable distance from the wall the pool cleaner is swung a half turn and then travels towards the opposite wall where it again swings round and returns parallel to the initial direction of travel, and so on. This machine can of course also be used for rectangular pools.

Instead of the control means governing the movement in response to detection of a pool wall by the sensors, it may contain a running program specifically programmed for the pool in question where the turning movements and the various driving lengths in an irregularly shaped pool are time-controlled.

According to curve B in FIG. 3, the cleaner is run until it is stopped by a pool wall, after which the drive is reversed for about 7 dm and then again reversed at the same time as one driving wheel is driven and the other allowed to run free. When a half turn has been completed, the drive is again connected for the second wheel, at the same time as the motor is reversed so that the machine backs towards the wall, stops and is aligned therewith, after which the drive is reversed so that the machine travels towards the other wall where the procedure is repeated.

Curve C illustrates a procedure in which the pool cleaner is provided with sensors capable of sensing the pool wall when still at a distance therefrom. The pool cleaner is stopped at a suitable distance from the wall, after which the control program causes it to turn half a turn, back to the wall, align itself with the wall and then run forwards.

It is of course possible to combine the driving procedures described above in various ways by suitable design of the control program. Other variants are also feasible. The essential feature is, however, that the machine is turned a half turn at the pool wall and is driven to and fro along parallel paths between two opposite pool walls.

I claim:

1. A method of cleaning a bottom portion of a pool with the aid of a self-propelling, motorized pool cleaner, the pool cleaner travelling to and fro, with parallel movement at change of direction, in straight paths between two opposite walls of the pool while collecting material lying at the bottom of the pool, said pool cleaner comprising drive members governing movement of the pool cleaner and control means arranged to emit control signals to the drive members in order to change the direction of travel when encountering a wall, comprising moving the pool cleaner in a straight path towards one wall, turning the pool cleaner a half turn, and simultaneously displacing the pool cleaner laterally perpendicular to the initial direction of travel, driving the pool cleaner thereafter on a path parallel to the initial direction of travel to the opposite wall of the pool, again turning the pool cleaner a half turn and simultaneously displacing the pool cleaner laterally in the same direction as the lateral displacement at the previous turn, and thereafter moving the pool cleaner back to the opposite wall of the pool, and repeating the process until the bottom portion of the pool has been covered.

2. A method as claimed n claim 1, wherein the pool cleaner comprises at least one first and one second rotary support member in contact with the bottom of the pool and each support member can be individually connected by coupling means to an element in the pool cleaner in a first coupling position and can be released from this element to a second coupling position in which the driving torque or rotary resistance for a support member is separated from the driving torque or the rotary resistance to which the support member is subjected in the first coupling position, the turning movement being effected by connecting the first support member in the first coupling position while the second support member is in the second coupling position, and the straight-line travel being effected by connecting both coupling members in the same coupling position, and turning at the opposite pool wall by connecting the second support member in the first coupling position and connecting the first coupling member in the second coupling position, and the turns continuing by connecting the support members alternately in the first and the second coupling positions.

3. A method as claimed in claim 2, wherein the first and second support members in the first coupling position are joined to said drive members of the pool cleaner.

4. A method as claimed in claim 2, wherein the first and second support members are retarded in the first coupling position.

5. A method as claimed in claim 2, wherein the first and second support members constitute wheels.

6. A method as claimed in claim 1, further comprising aligning the pool cleaner in relation to the pool wall before driving the pool cleaner towards the opposite pool wall.

7. A method as claimed in claim 1, wherein the pool cleaner includes reversible drive means, the method comprising driving the pool cleaner until it encounters a pool wall, then reversing the pool cleaner out from the wall, stopping the pool cleaner a short distance from the wall, and then turning the pool cleaner.

8. A method as claimed in claim 1, wherein the pool cleaner includes reversible drive means, and wherein after the pool cleaner is turned a half turn, reversing the pool cleaner towards the pool wall, aligning the pool cleaner with the pool wall and then driving the pool cleaner forwards towards the opposite pool wall.

* * * * *